US007438636B2

(12) United States Patent
Kulp et al.

(10) Patent No.: US 7,438,636 B2
(45) Date of Patent: Oct. 21, 2008

(54) CHEMICAL MECHANICAL POLISHING PAD

(75) Inventors: Mary Jo Kulp, Newark, DE (US); David B. James, Newark, DE (US); Robert F. Antrim, Chalfont, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/644,493

(22) Filed: Dec. 21, 2006

(65) Prior Publication Data

US 2008/0153395 A1 Jun. 26, 2008

(51) Int. Cl.
*B24D 11/00* (2006.01)

(52) U.S. Cl. ..... 451/539; 51/298; 51/307

(58) Field of Classification Search ..... 51/298, 51/307; 451/36, 41, 59, 63, 526, 539, 550
See application file for complete search history.

(56) References Cited

U.S. PATENT DOCUMENTS

| | | | | |
|---|---|---|---|---|
| 5,578,362 | A | 11/1996 | Reinhardt et al. | |
| 5,900,164 | A | 5/1999 | Budinger et al. | |
| 6,022,268 | A | 2/2000 | Roberts et al. | |
| 6,362,107 | B1 | 3/2002 | Shiro et al. | |
| 6,439,989 | B1 | 8/2002 | Reinhardt et al. | |
| 6,645,264 | B2 | 11/2003 | Hasegawa et al. | |
| 6,705,934 | B1 | 3/2004 | Shiro et al. | |
| 6,860,802 | B1 | 3/2005 | Vishwanathan et al. | |
| 7,029,747 | B2 | 4/2006 | Huh et al. | |
| 7,074,115 | B2 | 7/2006 | James et al. | |
| 7,169,030 | B1 | 1/2007 | Kulp | |
| 7,186,166 | B2 * | 3/2007 | Chen et al. | 451/28 |
| 7,220,167 | B2 * | 5/2007 | Feng et al. | 451/41 |
| 7,267,607 | B2 * | 9/2007 | Prasad | 451/285 |
| 2002/0002026 | A1 * | 1/2002 | Molnar | 451/8 |
| 2004/0053007 | A1 | 3/2004 | Huh et al. | |
| 2004/0171339 | A1 * | 9/2004 | Prasad | 451/526 |
| 2004/0177563 | A1 * | 9/2004 | Prasad | 51/298 |
| 2005/0042976 | A1 * | 2/2005 | Ronay | 451/41 |
| 2005/0276967 | A1 * | 12/2005 | Prasad | 428/314.8 |
| 2005/0277371 | A1 * | 12/2005 | Prasad | 451/285 |
| 2006/0030156 | A1 * | 2/2006 | Butterfield et al. | 438/691 |
| 2006/0046622 | A1 * | 3/2006 | Prasad | 451/41 |
| 2006/0052040 | A1 * | 3/2006 | Prasad | 451/41 |
| 2006/0084365 | A1 | 4/2006 | Sakurai et al. | |

(Continued)

OTHER PUBLICATIONS

Polyurethane Handbook, edited by Gunther Oertel, contributions from L. Abele et al. 2nd Edition, Hanser Gardner Publications, Inc. Cincinnati, OH, 1993, pp. 37-47.

(Continued)

*Primary Examiner*—Timothy V Eley
(74) *Attorney, Agent, or Firm*—Blake T. Biederman

(57) ABSTRACT

A chemical mechanical polishing pad is suitable for polishing at least one of semiconductor, optical and magnetic substrates. The polishing pad has a high modulus component forming a continuous polymeric matrix and an impact modifier within the continuous polymeric matrix. The high modulus component has a modulus of at least 100 MPa. The impact modifier includes a low modulus component having a modulus of at least one order of magnitude less than the high modulus component that increases the impact resistance of the polishing pad.

10 Claims, 2 Drawing Sheets

U.S. PATENT DOCUMENTS

| | | | | |
|---|---|---|---|---|
| 2006/0125133 | A1 | 6/2006 | Huh et al. | |
| 2006/0154573 | A1* | 7/2006 | Feng et al. | 451/41 |
| 2007/0049164 | A1* | 3/2007 | Thomson et al. | 451/5 |
| 2007/0178812 | A1* | 8/2007 | Shimomura et al. | 451/41 |
| 2007/0180778 | A1* | 8/2007 | Prasad | 51/298 |
| 2007/0251155 | A1* | 11/2007 | Dysard et al. | 51/298 |

OTHER PUBLICATIONS

Chemical-Mechanical Planarization of Semiconductor Materials, edited by M. R. Oliver, Springer, New York, NY, 2004, pp. 180-182.

* cited by examiner

CHEMICAL MECHANICAL POLISHING PAD

BACKGROUND OF THE INVENTION

This specification relates to polishing pads useful for polishing and planarizing substrates, such as semiconductor substrates or magnetic disks.

Polymeric polishing pads, such as polyurethane, polyamide, polybutadiene and polyolefin polishing pads represent commercially available materials for substrate planarization in the rapidly evolving electronics industry. Electronics industry substrates requiring planarization include silicon wafers, patterned wafers, flat panel displays and magnetic storage disks. In addition to planarization, it is essential that the polishing pad not introduce excessive numbers of defects, such as scratches or other wafer non-uniformities. Furthermore, the continued advancement of the electronics industry is placing greater demands on the planarization and defectivity capabilities of polishing pads.

For example, the production of semiconductors typically involves several chemical mechanical planarization (CMP) processes. In each CMP process, a polishing pad in combination with a polishing solution, such as an abrasive-containing polishing slurry or an abrasive-free reactive liquid, removes excess material in a manner that planarizes or maintains flatness for receipt of a subsequent layer. The stacking of these layers combines in a manner that forms an integrated circuit. The fabrication of these semiconductor devices continues to become more complex due to requirements for devices with higher operating speeds, lower leakage currents and reduced power consumption. In terms of device architecture, this translates to finer feature geometries and increased numbers of metallization levels. These increasingly stringent device design requirements are driving the adoption of smaller and smaller line spacing with a corresponding increase in pattern density. The devices' smaller scale and increased complexity have led to greater demands on CMP consumables, such as polishing pads and polishing solutions. In addition, as integrated circuits' feature sizes decrease, CMP-induced defectivity, such as, scratching becomes a greater issue. Furthermore, integrated circuits' decreasing film thickness requires improvements in defectivity while simultaneously providing acceptable topography to a wafer substrate; these topography requirements demand increasingly stringent planarity, line dishing and small feature array erosion polishing specifications.

Historically, cast polyurethane polishing pads have provided the mechanical integrity and chemical resistance for most polishing operations used to fabricate integrated circuits. For example, polyurethane polishing pads have sufficient tensile strength for resisting tearing; abrasion resistance for avoiding wear problems during polishing; and stability for resisting attack by strong acidic and strong caustic polishing solutions. Unfortunately, the hard cast polyurethane polishing pads that tend to improve planarization, also tend to increase defects.

James et al., in U.S. Pat. No. 7,074,115, disclose a family of hard polyurethane polishing pads with planarization ability similar to IC1000™ polyurethane polishing pads, but with improved defectivity perfonnance-IC1000 is a trademark of Rohm and Haas Company or its affiliates. Unfortunately, the polishing performance achieved with the polishing pad of James et al. varies with the polishing substrate and polishing conditions. For example, these polishing pads have limited advantage for polishing silicon oxide/silicon nitride applications, such as direct shallow trench isolation (STI) polishing applications. For purposes of this specification, silicon oxide refers to silicon oxide, silicon oxide compounds and doped silicon oxide formulations useful for forming dielectrics in semiconductor devices; and silicon nitride refers to silicon nitrides, silicon nitride compounds and doped silicon nitride formulations useful for semiconductor applications. These silicon compounds useful for creating semiconductor devices continue to evolve in different directions. Specific types of dielectric oxides in use include the following: TEOS formed from the decomposition of tetraethylorthosilicates, HDP ("high-density plasma") and SACVD ("sub-atmospheric chemical vapor deposition"). There is an ongoing need for additional polishing pads that have superior planarization ability in combination with improved defectivity performance.

STATEMENT OF THE INVENTION

One aspect of the invention provides a chemical mechanical polishing pad suitable for polishing at least one of semiconductor, optical and magnetic substrates, the polishing pad having a high modulus component forming a continuous polymeric matrix and an impact modifier within the continuous polymeric matrix, the high modulus component having a modulus of at least 100 MPa, the impact modifier having a low modulus component and the low modulus component having a modulus of at least one order of magnitude less than the high modulus component, an average length of 10 to 1,000 nm in at least one direction, being 1 to 50 volume percent of the polishing pad and wherein the low modulus component increases the impact resistance of the polishing pad.

Another aspect of the invention provides a chemical mechanical polishing pad suitable for polishing at least one of semiconductor, optical and magnetic substrates, the polishing pad having a high modulus component forming a continuous polymeric matrix and an impact modifier within the continuous polymeric matrix, the high modulus component having a modulus of 100 to 5,000 MPa, the impact modifier having a low modulus component and the low modulus component having a modulus of at least one order of magnitude less than the high modulus component, an average length of 20 to 800 nm in at least one direction, being 2 to 40 volume percent of the polishing pad and wherein the low modulus component increases the impact resistance of the polishing pad.

DETAILED DESCRIPTION OF THE INVENTION

The invention provides a polishing pad suitable for planarizing at least one of semiconductor, optical and magnetic substrates, the polishing pad comprising a polymeric matrix. For example, the polishing pads may be suitable for polishing and planarizing several semiconductor wafer applications, such as STI (HDP/SiN, TEOS/SiN or SACVD/SiN), copper, barrier (Ta, TaN, Ru) and tungsten. In addition, these pads maintain their surface structure to facilitate eCMP ("electrochemical mechanical planarization") applications. For example, perforations through the pad, the introduction of conductive-lined grooves or the incorporation of a conductor, such as a conductive fiber or metal wire, can transform the pads into eCMP polishing pads. The polishing pad's structure improves the pad's impact resistance and can have an unexpected benefit in polishing performance, such as planarization and defectivity. For purposes of this invention, an increase in a polishing pad's impact resistance may that measured with ASTM D5628-06. In this invention, materials of different moduli combine to control physical properties on length-scales similar to feature sizes of next generation patterned wafers. In particular, the invention achieves a range of polishing performance by distributing "soft" impact modifiers within a "harder" polymeric matrix. The unique polishing pad has a high modulus component with a modulus E' that is at least one order of magnitude higher than that of the low modulus component. Because it is often difficult to measure the modulus of impact modifiers, for purposes of this specification, determining the difference in modulus of the two components is a three step process. The first step involves determining the bulk modulus of the matrix component, such as through ASTM D 5418. Then the next step is to determine the bulk modulus of the final material containing the impact modifiers—this represents an ungrooved sample. Finally, solving the following equation calculates modulus of the impact modifier.

$$E'_{Final}=E'_{Matrix}*\text{Vol. }\%_{Matrix}+E'_{ImpactModifier}*\text{Vol. }\%_{ImpactModifier}$$

Figure 1:
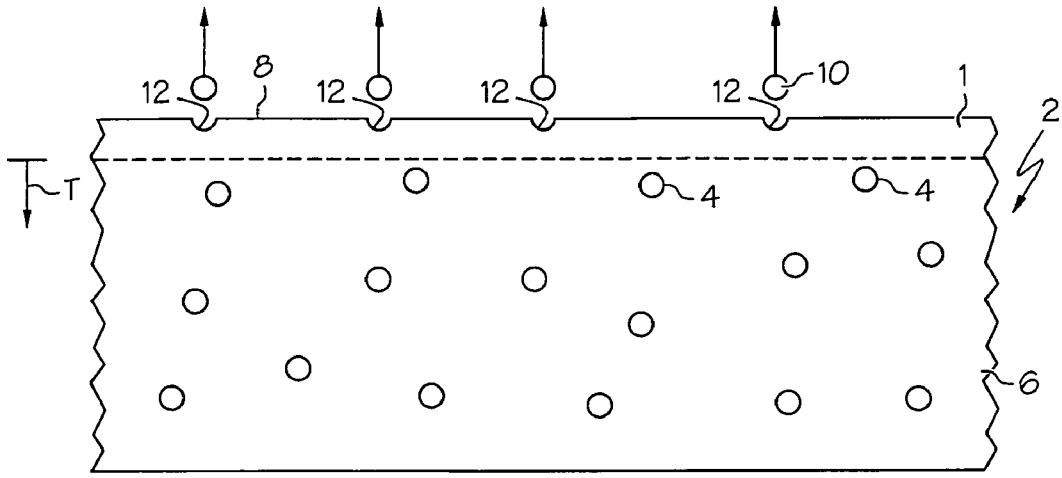
FIG. 1 is a partial cross-sectional view of a polishing pad of the present invention.

Referring now to the drawings, FIG. 1 discloses a polishing pad 2 having a polishing layer 1 and having a plurality of impact modifiers 4 embedded in a polymeric matrix material 6. The impact modifiers 4 preferably create amorphous-flexible-polymeric regions within a continuous polymeric matrix material 6. The matrix 6 represents a high bulk modulus polymeric component, such as a homogenous polymer matrix or a segmented polymer or copolymer. The impact modifiers 4 provide low modulus components within the continuous polymeric matrix 6. Impact modifiers 4 are distributed throughout a thickness T of the polishing pad 2 within the matrix material 6. The matrix material 6 may be selected to have a desired degree of elasticity, porosity, density, hardness, etc. in order to provide predetermined polishing and wear performance in conjunction with the selected impact modifiers 4.

Note, although illustrated in two dimensions in FIG. 1, one will appreciate that the matrix material 6 defines a three-dimensional structure. Impact modifiers 4 may be distributed evenly or randomly throughout the matrix material 6 in order to provide the desired polishing properties across the thickness T of the pad 2. Alternatively, a systematic array of impact modifiers 4 may be desired, with variations in the distribution of the impact modifiers 4 possible through the thickness T or across a diameter of the polishing surface 8. In another embodiment, there may be more impact modifiers 4 per unit volume of matrix material 6 as a function of the pad depth T. The number of impact modifiers 4 per unit volume may be selected in conjunction with the specification of the other pad properties in order to achieve a desired material removal performance for a particular application.

In one embodiment, as polishing surface 8 is used to polish one or more semiconductor wafers, a top portion of the polishing layer 1 is spent and the uppermost impact modifiers 4 will be released, thereby creating voids 12 and restoring a degree of roughness and porosity to the polishing surface 8. In this way, the polishing surface 8 requires minimal conditioning, if any. Also, in practice, the released modifiers 10 may simply be washed away with the spent slurry.

Figure 2:
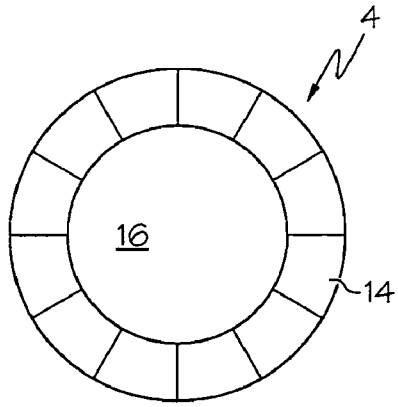
FIG. 2 is an exploded view of an impact modifier of the present invention.

Referring now to FIG. 2, the impact modifier 4 comprises a shell 14 that encapsulates or is grafted onto a core 16. The impact modifiers that are most suitable for the practice of this invention contain a rubber-like core component and a grafted rigid shell component. Preferred impact modifiers are prepared by grafting a (meth)acrylate and/or vinyl aromatic polymer, including copolymers thereof such as styrene/acrylonitrile, onto the selected rubber-like material. Preferably, the graft polymer is a homo or copolymer of methylmethacrylate.

The rubber-like material can be, for example, one or more of the well known butadiene-, butyl acrylate-, or EPDM-types. a preferred impact modifier contains as a rubber-like material, a substrate polymer latex or core that is made by polymerizing a conjugated diene, or by copolymerizing a conjugated diene with a mono-olefin or polar vinyl compound, such as styrene, acrylonitrile or methyl methacrylate. The substrate of the rubber-like material is typically made up of about 45 to 100 percent conjugated diene and up to about 55 percent of the mono-olefin or polar vinyl compound. a mixture of monomers is then graft polymerized to the substrate latex.

Preferable core materials include 1,3-dienes such as butadiene and isoprene. The rubber-like polymer may include 1,3-diene copolymers (e.g., butadiene-styrene copolymer, butadiene-styrene-(meth)acrylate terpolymers, butadiene-styrene-acrylonitrile terpolymers, isoprene-styrene copolymers, etc.). Of the aforementioned rubber-like polymers, those that can be produced as a latex are especially desirable. In particular, a butadiene-vinyl aromatic copolymer latex obtained as a result of emulsion polymerization is preferred. In the core, a partially crosslinked polymer can also be employed if crosslinking is moderate. Further, cross-or graft-linking monomers, otherwise described as a multi-functional unsaturated monomer, may also be copolymerized in the core. Such cross-or graft-linking monomers include divinylbenzene, diallyl maleate, butylene glycol diacrylate, ethylene glycol dimethacrylate, allyl methacrylate, alkyl(meth)acrylate, including, methyl acrylate, ethyl acrylate, n-propyl acrylate, n-butyl acrylate, 2-ethylhexyl acrylate, ethoxyethoxyethyl acrylate, methoxy tripropylene glycol acrylate, 4-hydroxybutyl acrylate, lauryl methacrylate and stearyl methacrylate. These alkyl(meth)acrylates are used alone, or two or more may be used in combination.

The ratio of comonomers in the core depends on the desired refractive index ("RI") of the core-shell polymer and the desired elastomeric properties. The ratio range of diolefin to the vinyl aromatic in the core polymer is 95:5 to 20:80, preferably 85:15 to 65:45 (parts by weight). If the quantity of butadiene is below 20 parts by weight, it is difficult to improve the impact resistance. If the quantity of butadiene exceeds 95 parts by weight, on the other hand, it may be difficult to obtain a modifier having an RI high enough to match that of the matrix polymer for clear impact-modified polymer blends. The ability to manipulate the refractive indices of these impact modifiers 4 may serve to be useful in so-called "clear pads" that allow for end-point detection through the pad without the aid of a window.

Optionally, a small concentration, from about 0 to about 5 percent by weight of a crosslinking monomer, such as divinylbenzene or butylene glycol dimethacrylate is included, and optionally about 0 to about 5 percent by weight of a graftlinking monomer for tying the core and shell together, such as allyl maleate may be included in the rubber-like core polymer. Further examples of crosslinking monomers include alkanepolyol polyacrylates or polymethacrylates such as ethylene glycol diacrylate, ethylene glycol dimethacrylate, butylene glycol diacrylate, oligoethylene glycol diacrylate, oligoethylene glycol dimethacrylate, trimethylolpropane diacrylate, trimethylolpropane dimethacrylate, trimethylol-propane triacrylate or trimethylolpropane trimethacrylate, and unsaturated carboxylic acid allyl esters such as allyl acrylate, allyl methacrylate or diallyl maleate.

A variety of monomers may be used for grafting the shell 14 onto the core 16, including, hard polymers or copolymers with a Tg above room temperature, and polymers prepared with C1-C4 alkyl methacrylate and vinyl aromatic monomers. Examples of suitable vinyl aromatic monomers include styrene, alpha-methyl styrene, para-methyl styrene, chlorostyrene, vinyl toluene, dibromostyrene, tribromostyrene, vinyl naphthalene, isopropenyl naphthalene, divinylbenzene and the like. Examples of the C1-C4 alkyl methacrylate monomers are ethyl methacrylate, propyl methacrylate, butyl methacrylate, and preferably methyl methacrylate.

Optionally, one or more additional monomers copolymerizable with the C1-C4 alkyl methacrylate and vinyl aromatic monomers may also be used in the outer shell composition. The additional monomer may include one or more of any of the following monomers: acrylonitrile, methacrylonitrile, methyl acrylate, ethyl acrylate, propyl acrylate, butyl acrylate, 2-ethylhexyl acrylate, decyl acrylate, methyl methacrylate, ethyl methacrylate, divinyl benzene, alpha-methyl styrene, para-methyl styrene, chlorostyrene, vinyl toluene, dibromostyrene, tribromostyrene, vinyl naphthalene, isopropenyl naphthalene, as well as higher carbon (C12-C20) alkyl methacrylates and acrylates such as lauryl methacrylate, lauryl acrylate, stearyl methacrylate, stearyl acrylate, isobornyl methacrylate. Additionally, the C1-C4 alkyl methacrylate monomers and vinyl aromatic monomers may be used alone or in combination with each other. The extent of grafting is sensitive to the substrate latex particle size and grafting reaction conditions, and particle size may be influenced by controlled coagulation techniques among other methods. The shell 14 may be crosslinked during the polymerization by incorporation of various polyvinyl monomers such as divinyl benzene and the like.

The grafting monomers may be added to the reaction mixture simultaneously or in sequence, and, when added in sequence, layers, shells 14 or wart-like appendages can be built up around the substrate latex, or core 16. The monomers can be added in various ratios to each other. Preferred impact modifiers include a butadiene-based core with a methacrylate-based shell, for example, methacrylate-butadiene-styrene ("MBS") rubber-like materials such as Paraloid™ EXL 3607. Also, other modifiers include methylmethacrylate butylacrylate ("MBA") rubber-like materials such as Paraloid™ 3300 core-shell polymers that generally contain 45-90 weight percent elastomer. Both are commercially available from the Rohm and Haas Company of Philadelphia, Pa. "Paraloid" is a trademark registered to Rohm and Haas Company and its affiliates.

Figure 3:
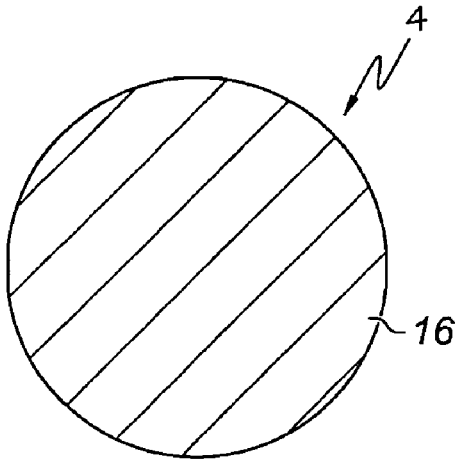
FIG. 3 is an exploded view of another embodiment of the impact modifier of the present invention.

Preferably, the impact modifier 4 will contain at least 40 weight percent of the rubber-like (core) material, more preferably at least 45 and most preferably at least 60 weight percent of the rubber-like material. The impact modifier 4 can contain up to 100 weight percent rubber-like material (see discussion of FIG. 3 below) and preferably contains less than 95 weight percent of the rubber-like material, more preferably less than 90 weight percent of the rubber-like material with the balance being a high modulus polymer wherein at least a significant portion is graft polymerized or crosslinked around or to the elastomeric material.

Optionally, the impact modifiers of the present invention may contain polymer particles that are useful as processing aids. Typically, processing aids have polymer compositions exhibiting a glass transition ("Tg") higher than 25° C. Typically, processing aids have polymer compositions with molecular weights ("MW") greater than 1 million g/mol. More typically, processing aids have molecular weights greater than 3 million g/mol. In certain applications, processing aids may have molecular weights greater than 6 million.

Optionally, the impact modifiers of the present invention may also include other plastics additives, including: waxes; pigments; opacifiers; fillers; exfoliated clays; toners; antistatic agents; metals; flame retardants; thermal stabilizers; co-stabilizers; antioxidants; cellulosic materials; other impact modifiers; processing aids; lubricating processing aids; internal lubricants; external lubricants; oils; rheology modifiers; powder flow aids; melt-flow aids; dispersing aids; UV stabilizers; plasticizers; fillers; optical modifiers; surface roughness modifiers; surface chemistry modifiers; adhesion modifiers; surface hardeners; compatibilizers; diffusion barrier modifiers; stiffeners; flexibilizers; mold release agents; processing modifiers; blowing agents; thermal insulators; thermal conductors; electronic insulators; electronic conductors; biodegradation agents; antistatic agents; internal release agents; coupling agents; flame retardants; smoke-suppressers; anti-drip agents; colorants; and combinations thereof. These optional plastics additives can be subsequently added by various powder processes such as: powder post-blending; co-spray drying; and co-agglomeration.

Note, the impact modifier's core-shell polymer particles are typically spherically-shaped. However, they can have any suitable shape. Various shapes of core-shell polymer particles can be prepared by processes known in the art of polymer particle technology. Examples of such suitable shapes of particles include: rubber-like core/hard shell inhomogeneous particles, hard shell/rubber-like core particles, particles having more complex (e.g., three-stage, soft/soft/hard, soft/hard/soft, hard/soft/hard; four-stage soft/hard/soft/hard, etc.) morphologies; ellipsoidal particles having an aspect ratio greater than 1:1; raspberry-shaped particles; multi-lobe-shaped particles; dumbbell-shaped particles; agglomerated particles; bilobal particles; angular particles; irregular-shaped particles and hollow sphere particles.

In another embodiment of the present invention, as discussed above, FIG. 3 illustrates the impact modifier 4 wholly comprised of core 16. In this embodiment, core 16 and the shell 14 (of FIG. 2) are the same. In other words, shell 14 does not coat a core 16 (as in FIG. 2), but, rather, the material that comprises a core 16, is the impact modifier 4.

Referring back to FIG. 1, the polishing pad 2 comprises a polymeric matrix material 6. Preferred polymeric matrix materials include, for example, polyurethanes. Polyurethanes, and other block or segmented co-polymers having chain segments with limited miscibility, tend to separate into regions having properties that depend on the properties of each block or segment. The elastomeric behavior of such matrix materials is attributed to the distinct morphology that allows chain extension through reorganization in amorphous soft segment regions while ordered harder segments help the material retain its integrity. The polymeric system has at least two components, a first high modulus matrix and a second lower modulus component distributed within the matrix in a manner that increases the impact resistance of the material. In addition, it is possible to introduce additional structure into the polishing pad to further adjust polishing performance, such as, hollow polymeric microspheres, water soluble particles, abrasive particles and fibers.

The two-component structure can be visualized through microscopy such as electron microscopy, including transmission or tapping mode scanning probe microscopy. The preferred method for determining volume fractions impact modifiers and matrix material will vary with the polymer system evaluated.

The arrangement of these high modulus and low modulus components into an overall material morphology depends on the amount of each block or segment in the system, mixing method and their miscibility, with the larger volume of material generally acting as the matrix, while the smaller volume of material forms islands within the matrix. In pads of the current invention, these materials contain at least 50 volume percent high modulus matrix, exclusive of porous or other non-impact modifier fillers. Example ranges include 50 to 98 volume percent high modulus matrix, exclusive of porous or other non-impact modifier fillers and 55 to 95 volume percent high modulus matrix, exclusive of porous or other non-impact modifier fillers. At this level of high modulus polymer matrix, the matrix is generally continuous with some degree of low modulus polymer mixed in. High modulus polymer materials tend to be better for planarizing in CMP processes than are low modulus materials, but they also tend to be more likely to produce scratches on wafers.

The high modulus component has a modulus of at least 100 MPa. Preferably, the high modulus component has a modulus of 100 to as high as 5,000 MPa for aramid polymers. Typical high modulus components will have a modulus between 100 and 2,500 MPa and polyurethane type high modulus components will have a modulus between 200 and 1,000 MPa.

The low modulus components preferably have an average length of at least 10 nm in at least one direction, such as width or length. For example, typical average length ranges for the low modulus components are 10 to 1,000 nm and 20 to 800 nm in at least one direction. Preferably, average length of the low modulus component is 40 to 500 nm in at least one direction.

Typical polymeric polishing pad matrix materials include polycarbonate, polysulphone, nylon, ethylene copolymers, polyethers, polyesters, polyether-polyester copolymers, acrylic polymers, polymethyl methacrylate, polyvinyl chloride, polycarbonate, polyethylene copolymers, polybutadiene, polyethylene imine, polyurethanes, polyether sulfone, polyether imide, polyketones, epoxies, silicones, copolymers thereof and mixtures thereof. Preferably, the polymeric material is a polyurethane; and may be either a cross-linked a non-cross-linked polyurethane. For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof.

Cast polyurethane matrix materials are suitable for planarizing semiconductor, optical and magnetic substrates. The pads' particular polishing properties arise in part from a prepolymer reaction product of a prepolymer polyol and a polyfunctional isocyanate. The prepolymer product is cured with a curative agent selected from the group comprising curative polyamines, curative polyols, curative alcohol amines and mixtures thereof to form a polishing pad.

The polishing pads may contain a porosity concentration of at least 0.1 volume percent. Porosity includes gas-filled particles, gas-filled spheres and voids formed from other means, such as mechanically frothing gas into a viscous system, injecting gas into the polyurethane melt, introducing gas in situ using a chemical reaction with gaseous product, or decreasing pressure to cause dissolved gas to form bubbles. This porosity contributes to the polishing pad's ability to transfer polishing fluids during polishing. Preferably, the polishing pad has a porosity concentration of 0.2 to 70 volume percent. Most preferably, the polishing pad has a porosity concentration of 0.3 to 65 volume percent. Preferably the pores particles have a weight average diameter of 1 to 100 μm. Most preferably, the pores particles have a weight average diameter of 10 to 90 μm. The nominal range of expanded hollow-polymeric microspheres' weight average diameters is 15 to 90 μm. Furthermore, a combination of high porosity with small pore size can have particular benefits in reducing defectivity. For example, a pore size of 2 to 50 μm constituting 25 to 65 volume percent of the polishing layer facilitates a reduction in defectivity. Furthermore, maintaining porosity between 40 and 60 volume percent can have a particular benefit to defectivity. Additionally, oxide:SiN selectivity is frequently adjustable by adjusting the level of porosity, with higher levels of porosity giving lower oxide selectivity.

Preferably, the polymeric matrix material is a block or segmented copolymer capable of separating into phases rich in one or more blocks or segments of the copolymer. Most preferably the polymeric material is a polyurethane. An approach for controlling a pad's polishing properties is to alter its chemical composition. In addition, the choice of raw materials and manufacturing process affects the polymer morphology and the final properties of the material used to make polishing pads.

Preferably, urethane production involves the preparation of an isocyanate-terminated urethane prepolymer from a polyfunctional aromatic isocyanate and a prepolymer polyol. For purposes of this specification, the term prepolymer polyol includes diols, polyols, polyol-diols, copolymers thereof and mixtures thereof. Preferably, the prepolymer polyol is selected from the group comprising polytetramethylene ether glycol [PTMEG], polypropylene ether glycol [PPG], ester-based polyols, such as ethylene or butylene adipates, copolymers thereof and mixtures thereof. Example polyfunctional aromatic isocyanates include 2,4-toluene diisocyanate, 2,6-toluene diisocyanate, 4,4'-diphenylmethane diisocyanate, naphthalene-1,5-diisocyanate, tolidine diisocyanate, paraphenylene diisocyanate, xylylene diisocyanate and mixtures thereof. The polyfunctional aromatic isocyanate contains less than 20 weight percent aliphatic isocyanates, such as 4,4'-dicyclohexylmethane diisocyanate, isophorone diisocyanate and cyclohexanediisocyanate. Preferably, the polyfunctional aromatic isocyanate contains less than 15 weight percent aliphatic isocyanates and more preferably, less than 12 weight percent aliphatic isocyanate.

Example prepolymer polyols include polyether polyols, such as, poly(oxytetramethylene)glycol, poly(oxypropylene) glycol and mixtures thereof, polycarbonate polyols, polyester polyols, polycaprolactone polyols and mixtures thereof. Example polyols can be mixed with low molecular weight polyols, including ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol, dipropylene glycol, tripropylene glycol and mixtures thereof.

Preferably the prepolymer polyol is selected from the group comprising polytetramethylene ether glycol, polyester polyols, polypropylene ether glycols, polycaprolactone polyols, copolymers thereof and mixtures thereof. If the prepolymer polyol is PTMEG, copolymer thereof or a mixture thereof, then the isocyanate-terminated reaction product preferably has a weight percent unreacted NCO range of 5.0 to 20.0 wt. %. For polyurethanes formed with PTMEG or PTMEG blended with PPG, the preferable weight percent NCO is a range of 8.75 to 12.0; and most preferably it is 8.75 to 10.0. Particular examples of PTMEG family polyols are as follows: Terathane® 2900, 2000, 1800, 1400, 1000, 650 and 250 from Invista; Polymeg® 2900, 2000, 1000, 650 from Lyondell; PolyTHF® 650, 1000, 2000 from BASF, and lower molecular weight species such as 1,2-butanediol, 1,3-butanediol, and 1,4-butanediol. If the prepolymer polyol is a PPG, copolymer thereof or a mixture thereof, then the isocyanate-terminated reaction product most preferably has a weight percent unreacted NCO range of 7.9 to 15.0 wt. %. Particular examples of PPG polyols are as follows: Arcol® PPG-425, 725, 1000, 1025, 2000, 2025, 3025 and 4000 from Bayer; Voranol® 1010L, 2000L, and P400 from Dow; Desmophen® 1110BD, Acclaim® Polyol 12200, 8200, 6300, 4200, 2200 both product lines from Bayer If the prepolymer polyol is an ester, copolymer thereof or a mixture thereof, then the isocyanate-terminated reaction product most preferably has a weight percent unreacted NCO range of 6.5 to 13.0. Particular examples of ester polyols are as follows: Millester 1, 11, 2, 23, 132, 231, 272, 4, 5, 510, 51, 7, 8, 9, 10, 16, 253, from Polyurethane Specialties Company, Inc.; Desmophen® 1700, 1800, 2000, 2001KS, 2001K$^2$, 2500, 2501, 2505, 2601, PE65B from Bayer; Rucoflex S-1021-70, S-1043-46, S-1043-55 from Bayer.

Typically, the prepolymer reaction product is reacted or cured with a curative polyol, polyamine, alcohol amine or mixture thereof. For purposes of this specification, polyamines include diamines and other multifunctional amines. Example curative polyamines include aromatic diamines or polyamines, such as, 4,4'-methylene-bis-o-chloroaniline [MBCA], 4,4'-methylene-bis-(3-chloro-2,6-diethylaniline) [MCDEA]; dimethylthiotoluenediamine; trimethyleneglycol di-p-aminobenzoate; polytetramethyleneoxide di-p-aminobenzoate; polytetramethyleneoxide mono-p-aminobenzoate; polypropyleneoxide di-p-aminobenzoate; polypropyleneoxide mono-p-aminobenzoate; 1,2-bis(2-aminophenylthio)ethane; 4,4'-methylene-bis-aniline; diethyltoluenediamine; 5-tert-butyl-2,4- and 3-tert-butyl-2,6-toluenediamine; 5-tert-amyl-2,4- and 3-tert-amyl-2,6-toluenediamine and chlorotoluenediamine. Optionally, it is possible to manufacture urethane polymers for polishing pads with a single mixing step that avoids the use of prepolymers.

The components of the polymer used to make the polishing pad are preferably chosen so that the resulting pad morphology is stable and easily reproducible. For example, when mixing 4,4'-methylene-bis-o-chloroaniline [MBCA] with diisocyanate to form polyurethane polymers, it is often advantageous to control levels of monoamine, diamine and triamine. Controlling the proportion of mono-, di- and tri-amines contributes to maintaining the chemical ratio and resulting polymer molecular weight within a consistent range. In addition, it is often important to control additives such as anti-oxidizing agents, and impurities such as water for consistent manufacturing. For example, since water reacts with isocyanate to form gaseous carbon dioxide, controlling the water concentration can affect the concentration of carbon dioxide bubbles that form pores in the polymeric matrix. Isocyanate reaction with adventitious water also reduces the available isocyanate for reacting with chain extender, so changes the stoichiometry along with level of crosslinking (if there is an excess of isocyanate groups) and resulting polymer molecular weight.

The polyurethane polymeric material is preferably formed from a prepolymer reaction product of toluene diisocyanate and polytetramethylene ether glycol with an aromatic diamine. Most preferably the aromatic diamine is 4,4'-methylene-bis-o-chloroaniline or 4,4'-methylene-bis-(3-chloro-2,6-diethylaniline). Preferably, the prepolymer reaction product has a 6.5 to 15.0 weight percent unreacted NCO. Examples of suitable prepolymers within this unreacted NCO range include: Airthane® prepolymers PET-70D, PHP-70D, PET-75D, PHP-75D, PPT-75D, PHP-80D manufactured by Air Products and Chemicals, Inc. and Adiprene® prepolymers, LFG740D, LF700D, LF750D, LF751D, LF753D, L325 manufactured by Chemtura. In addition, blends of other prepolymers besides those listed above could be used to reach to appropriate percent unreacted NCO levels as a result of blending. Many of the above-listed prepolymers, such as, LFG740D, LF700D, LF750D, LF751D, and LF753D are low-free isocyanate prepolymers that have less than 0.1 weight percent free TDI monomer and have a more consistent prepolymer molecular weight distribution than conventional prepolymers, and so facilitate forming polishing pads with excellent polishing characteristics. This improved prepolymer molecular weight consistency and low free isocyanate monomer give a more regular polymer structure, and contribute to improved polishing pad consistency. For most prepolymers, the low free isocyanate monomer is preferably below 0.5 weight percent. Furthermore, "conventional" prepolymers that typically have higher levels of reaction (i.e. more than one polyol capped by a diisocyanate on each end) and higher levels of free toluene diisocyanate prepolymer should produce similar results. In addition, low molecular weight polyol additives, such as, diethylene glycol, butanediol and tripropylene glycol facilitate control of the prepolymer reaction product's weight percent unreacted NCO.

In addition to controlling weight percent unreacted NCO, the curative and prepolymer reaction product typically has an OH or $NH_2$ to unreacted NCO stoichiometric ratio of 85 to 120 percent, preferably 85 to 110 percent; and most preferably, it has an OH or $NH_2$ to unreacted NCO stoichiometric ratio of greater than 90 to 105 percent. This stoichiometry could be achieved either directly, by providing the stoichiometric levels of the raw materials, or indirectly by reacting some of the NCO with water either purposely or by exposure to adventitious moisture.

Preferably, the quantity of impact modifier 4 employed is from 1 to 50 and more preferably from 2 to 25 weight percent of the combined weight of the polymeric matrix of the polishing pad. Moreover, sufficient quantities of the impact modifier 4 may be employed to give a desired increase or decrease in the low modulus component relative to the high modulus matrix component of the polymeric matrix. In particular, sufficient quantities of the impact modifier 4 may be utilized to provide a polishing pad with an improved impact resistance, wherein the high modulus matrix component is higher than the second low modulus by at least one order of magnitude. More preferably, the first modulus is higher than the second modulus by at least two orders of magnitude, to provide a polishing pad with improved polishing performance.

The impact modifiers 4 of the present invention may be manufactured utilizing standard polymerization techniques, including, emulsion polymerization. The core-shell polymers may be isolated from the emulsion in various ways, including, spray-drying or coagulation. Then, the impact modifiers 4 having the core-shell structure may be admixed with the polymeric materials comprising the matrix of the polishing pad 2 of the present invention. In addition, the impact modifier 4 may optionally be grown in-situ within the polymeric matrix of the polishing pad 2. Alternatively, the impact modifier may be cryo-ground and then added to the polymer matrix.

Figure 4:
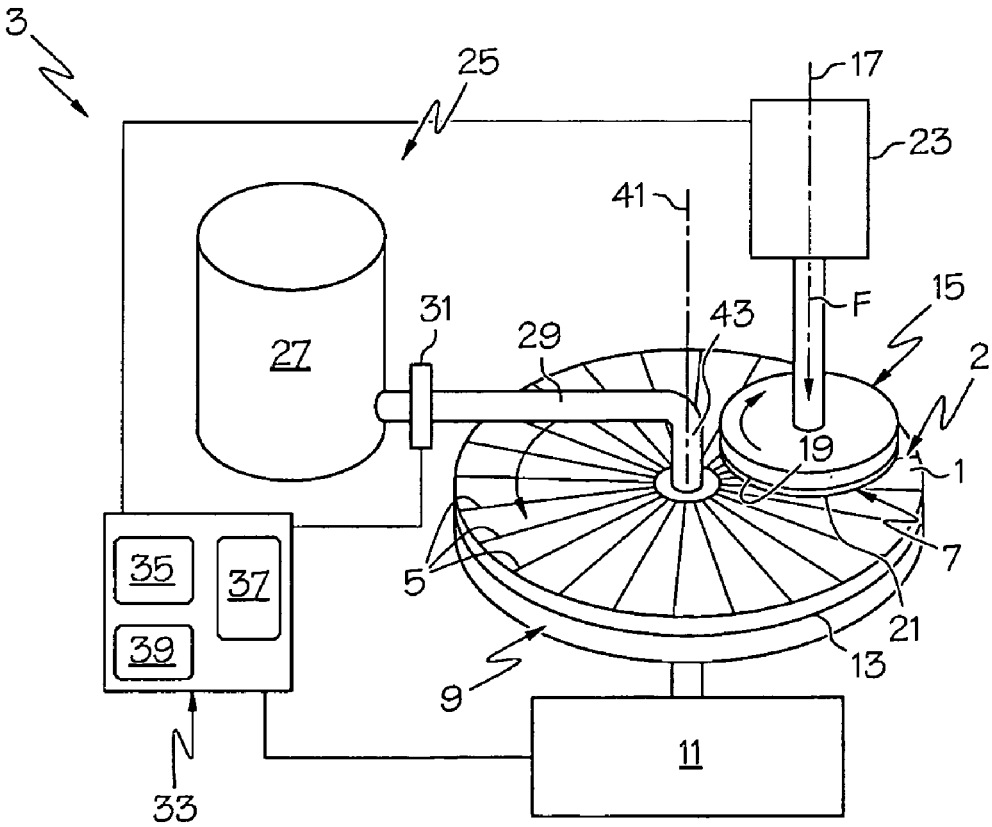
FIG. 4 is a partial schematic diagram and partial perspective view of a chemical mechanical polishing (CMP) system utilizing the polishing pad of the present invention.

Referring now to FIG. 4, a chemical mechanical polishing (CMP) system 3, utilizing the polishing pad 2 of the present invention is illustrated. CMP system 3 includes a polishing pad 2 having a polishing layer 1 that includes a plurality of grooves 5 (not shown) arranged and configured for enhancing the utilization of a slurry 43, or other liquid polishing medium, applied to the polishing pad 2 during polishing of a semiconductor substrate, such as a semiconductor wafer 7 or other workpiece, such as glass, silicon wafers and magnetic information storage disks, among others. For convenience, the term "wafer" is used in the description below. However, those skilled in the art will appreciate that workpieces other than wafers are within the scope of the present invention.

CMP system 3 may include a polishing platen 9 rotatable about an axis 41 by a platen driver 11. Platen 9 may have an upper surface 13 on which polishing pad 2 is mounted. a wafer carrier 15 rotatable about an axis 17 may be supported above polishing layer 1. Wafer carrier 15 may have a lower surface 19 that engages wafer 7. Wafer 7 has a surface 21 that faces polishing layer 1 and is planarized during polishing. Wafer carrier 15 may be supported by a carrier support assembly 23 adapted to rotate wafer 7 and provide a downward force F to press wafer surface 21 against polishing layer 1 so that a desired pressure exists between the wafer surface 21 and the polishing layer 1 during polishing.

CMP system 3 may also include a slurry supply system 25 for supplying slurry 43 to polishing layer 1. Slurry supply system 25 may include a reservoir 27, e.g., a temperature controlled reservoir, that holds slurry 43. a conduit 29 may carry slurry 43 from reservoir 27 to a location adjacent polishing pad 2 where the slurry is dispensed onto polishing layer 1. A flow control valve 31 may be used to control the dispensing of slurry 43 onto pad 2.

CMP system 3 may be provided with a system controller 33 for controlling the various components of the system, such as flow control valve 31 of slurry supply system 25, platen driver 11 and carrier support assembly 23, among others, during loading, polishing and unloading operations. In the exemplary embodiment, system controller 33 includes a processor 35, memory 37 connected to the processor, and support circuitry 39 for supporting the operation of the processor, memory and other components of the system controller.

During the polishing operation, system controller 33 causes platen 9 and polishing pad 2 to rotate and activates slurry supply system 25 to dispense slurry 43 onto the rotating polishing pad 2. The slurry spreads out over polishing layer 1 due to the rotation of polishing pad 2, including the gap between wafer 7 and polishing pad 2. System controller 33 may also cause wafer carrier 15 to rotate at a selected speed, e.g., 0 rpm to 150 rpm, so that wafer surface 21 moves relative to the polishing layer 1. System controller 33 may further control wafer carrier 15 to provide a downward force F so as to induce a desired pressure, e.g., 0 psi (0 kPa) to 15 psi (103 kPa), between wafer 7 and polishing pad 2. System controller 33 further controls the rotational speed of polishing platen 9, which is typically rotated at a speed of 0 to 150 rpm.

The invention claimed is:

1. A chemical mechanical polishing pad suitable for polishing at least one of semiconductor, optical and magnetic substrates, the polishing pad having a high modulus component forming a continuous polymeric matrix and an impact modifier within the continuous polymeric matrix, the high modulus component having a modulus of at least 100 MPa, the impact modifier having a low modulus component and the low modulus component having a modulus of at least one order of magnitude less than the high modulus component, an average length of 10 to 1,000 nm in at least one direction, being 1 to 50 volume percent of the polishing pad and wherein the low modulus component increases the impact resistance of the polishing pad.

2. The polishing pad of claim 1 wherein the high modulus component has a modulus of 100 to 5,000 MPa.

3. The polishing pad of claim 1 wherein the low modulus component has an average length of 20 to 800 nm in at least one direction.

4. The polishing pad of claim 1 wherein the low modulus component comprises a core-shell structure.

5. The polishing pad of claim 1 wherein the low modulus component comprises a butadiene-styrene copolymer, butadiene-styrene-(meth)acrylate terpolymers, butadiene-styrene-acrylonitrile terpolymers, isoprene-styrene copolymers, divinylbenzene, diallyl maleate, butylene glycol diacrylate, ethylene glycol dimethacrylate, allyl methacrylate, methyl acrylate, ethyl acrylate, n-propyl acrylate, n-butyl acrylate, 2-ethylhexyl acrylate, ethoxyethoxyethyl acrylate, methoxy tripropylene glycol acrylate, 4-hydroxybutyl acrylate, lauryl methacrylate and stearyl methacrylate.

6. A chemical mechanical polishing pad suitable for polishing at least one of semiconductor, optical and magnetic substrates, the polishing pad having a high modulus component forming a continuous polymeric matrix and an impact modifier within the continuous polymeric matrix, the high modulus component having a modulus of 100 to 5,000 MPa, the impact modifier having a low modulus component and the low modulus component having a modulus of at least one order of magnitude less than the high modulus component, an average length of 20 to 800 nm in at least one direction, being 2 to 40 volume percent of the polishing pad and wherein the low modulus component increases the impact resistance of the polishing pad.

7. The polishing pad of claim 6 wherein the polymeric matrix includes a polymer derived from difunctional or polyfunctional isocyanates and the polymeric matrix includes at least one selected from polyetherureas, polyisocyanurates, polyurethanes, polyureas, polyurethaneureas, copolymers thereof and mixtures thereof.

8. The polishing pad of claim 7 including water soluble particles or hollow polymeric shells.

9. The polishing pad of claim 7 wherein the high modulus component has a modulus of 200 to 1,000 MPa.

10. The polishing pad of claim 6 wherein the low modulus component has an average length of 40 to 500 nm in at least one direction.

* * * * *